US008297358B2

(12) United States Patent
Korkmaz et al.

(10) Patent No.: US 8,297,358 B2
(45) Date of Patent: Oct. 30, 2012

(54) AUTO-PRODUCTION FRAC TOOL

(75) Inventors: Lale Korkmaz, Houston, TX (US); Calvin J. Stowe, II, Bellaire, TX (US)

(73) Assignee: Baker Hughes Incorporated, Houston, TX (US)

( * ) Notice: Subject to any disclaimer, the term of this patent is extended or adjusted under 35 U.S.C. 154(b) by 371 days.

(21) Appl. No.: 12/804,250

(22) Filed: Jul. 16, 2010

(65) Prior Publication Data

US 2012/0012322 A1 Jan. 19, 2012

(51) Int. Cl.
*E21B 43/26* (2006.01)

(52) U.S. Cl. ..... 166/308.1; 166/177.5; 166/373; 166/318

(58) Field of Classification Search ..... 166/318, 166/308.1, 177.5, 194, 373, 244.1
See application file for complete search history.

(56) References Cited

U.S. PATENT DOCUMENTS

| | | | | |
|---|---|---|---|---|
| 2,224,538 | A | 12/1940 | Eckel et al. | |
| 3,090,442 | A | 5/1963 | Cochran et al. | |
| 3,220,481 | A | 11/1965 | Park | |
| 3,220,491 | A | 11/1965 | Mohr | |
| 3,776,258 | A | 12/1973 | Dockins, Jr. | |
| 4,114,694 | A | 9/1978 | Dinning | |
| 4,292,988 | A | 10/1981 | Montgomery | |
| 4,429,747 | A * | 2/1984 | Williamson, Jr. | 166/321 |
| 4,519,451 | A | 5/1985 | Gray et al. | |
| 4,520,870 | A | 6/1985 | Pringle | |
| 4,541,484 | A | 9/1985 | Salerni et al. | |
| 4,653,586 | A | 3/1987 | Skinner | |
| 4,718,494 | A | 1/1988 | Meek | |
| 4,729,432 | A | 3/1988 | Helms | |
| 4,823,882 | A | 4/1989 | Stokley et al. | |
| 4,828,037 | A | 5/1989 | Lindsey et al. | |

(Continued)

FOREIGN PATENT DOCUMENTS

EP 1258594 A2 11/2002

(Continued)

OTHER PUBLICATIONS

Notification of Transmittal of the International Search Report and the Written Opinion of the International Searching Authority, or the Declaration, Dec. 15, 2011, pp. 1-2, PCT/US2011/040805, Korean Intellectual Property Office.

(Continued)

*Primary Examiner* — Daniel P Stephenson
*Assistant Examiner* — Blake Michener
(74) *Attorney, Agent, or Firm* — Greenberg Traurig LLP; Anthony F. Matheny

(57) ABSTRACT

Fracturing tools for use in oil and gas wells comprise an inner sleeve, an outer sleeve, a run-in position, and two operational positions. The inner sleeve comprises two ports and two positions. The first port is aligned with a first port of the housing when the tool and sleeve are in the first operational position and is closed when the tool and sleeve are in the run-in position. After performing the first operation, the inner sleeve is returned to its initial position and the outer sleeve is moved placing the tool in the second operational position in which the second port in the inner sleeve is in fluid communication with a second port in the housing. Movement of the tool from the first operational position to the second operational position so that a second operation can be performed is done without the need for an additional well intervention step.

23 Claims, 2 Drawing Sheets

U.S. PATENT DOCUMENTS

| | | | | |
|---|---|---|---|---|
| 4,840,229 | A | 6/1989 | Proctor et al. | |
| 4,862,966 | A | 9/1989 | Lindsey et al. | |
| 4,893,678 | A | 1/1990 | Stokley et al. | |
| 4,915,172 | A | 4/1990 | Donovan et al. | |
| 4,967,841 | A | 11/1990 | Murray | |
| 5,036,920 | A | 8/1991 | Cornette et al. | |
| 5,146,992 | A | 9/1992 | Baugh | |
| 5,325,921 | A | 7/1994 | Johnson et al. | |
| 5,327,960 | A | 7/1994 | Cornette et al. | |
| 5,332,038 | A | 7/1994 | Tapp et al. | |
| 5,348,092 | A | 9/1994 | Cornette et al. | |
| 5,366,009 | A | 11/1994 | Cornette et al. | |
| 5,394,938 | A | 3/1995 | Cornette et al. | |
| 5,396,957 | A | 3/1995 | Surjaatmadja et al. | |
| 5,411,090 | A | 5/1995 | Cornette et al. | |
| 5,425,424 | A | 6/1995 | Reinhardt et al. | |
| 5,443,117 | A | 8/1995 | Ross | |
| 5,499,678 | A | 3/1996 | Surjaatmadja et al. | |
| 5,722,490 | A | 3/1998 | Ebinger | |
| 5,730,223 | A | 3/1998 | Restarick | |
| 5,732,775 | A * | 3/1998 | Hudson et al. | 166/177.4 |
| 5,960,881 | A | 10/1999 | Allamon et al. | |
| 6,053,248 | A | 4/2000 | Ross | |
| 6,065,535 | A | 5/2000 | Ross | |
| 6,079,496 | A | 6/2000 | Hirth | |
| 6,155,342 | A | 12/2000 | Oneal | |
| 6,186,236 | B1 | 2/2001 | Cox | |
| 6,216,785 | B1 | 4/2001 | Achee, Jr. et al. | |
| 6,253,861 | B1 * | 7/2001 | Carmichael et al. | 175/237 |
| 6,382,324 | B1 | 5/2002 | Anyan | |
| 6,530,574 | B1 | 3/2003 | Bailey et al. | |
| 6,533,037 | B2 | 3/2003 | Eslinger et al. | |
| 6,601,646 | B2 | 8/2003 | Streich et al. | |
| 6,832,654 | B2 | 12/2004 | Ravensbergen et al. | |
| 6,896,049 | B2 | 5/2005 | Moyes | |
| 6,923,262 | B2 | 8/2005 | Broome et al. | |
| 6,929,066 | B2 | 8/2005 | Hill | |
| 6,938,690 | B2 | 9/2005 | Surjaatmadja | |
| 7,066,264 | B2 | 6/2006 | Bissonnette et al. | |
| 7,066,265 | B2 | 6/2006 | Surjaatmadja | |
| 7,078,370 | B2 | 7/2006 | Crews | |
| 7,096,943 | B2 | 8/2006 | Hill | |
| 7,166,560 | B2 | 1/2007 | Still et al. | |
| 7,331,388 | B2 | 2/2008 | Vilela et al. | |
| 7,469,744 | B2 | 12/2008 | Ruddock et al. | |
| 7,503,384 | B2 | 3/2009 | Coronado | |
| 7,640,988 | B2 | 1/2010 | Phi et al. | |
| 7,673,673 | B2 | 3/2010 | Surjaatmadja et al. | |
| 7,703,510 | B2 | 4/2010 | Xu | |
| 7,819,193 | B2 | 10/2010 | Savoy et al. | |
| 7,841,411 | B2 | 11/2010 | Fuller et al. | |
| 2002/0117301 | A1 | 8/2002 | Womble | |
| 2002/0162661 | A1 | 11/2002 | Krauss et al. | |
| 2004/0140089 | A1 | 7/2004 | Gunneroed | |
| 2004/0211560 | A1 | 10/2004 | Richard et al. | |
| 2005/0061508 | A1 | 3/2005 | Surjaatmadja | |
| 2005/0279501 | A1 | 12/2005 | Surjaatmadja et al. | |
| 2006/0118301 | A1 | 6/2006 | East, Jr. et al. | |
| 2006/0191685 | A1 | 8/2006 | Coronado | |
| 2006/0196674 | A1 | 9/2006 | Butler et al. | |
| 2006/0283596 | A1 | 12/2006 | Mahdi et al. | |
| 2007/0029080 | A1 | 2/2007 | Moyes | |
| 2007/0039741 | A1 | 2/2007 | Hailey, Jr. | |
| 2007/0187095 | A1 | 8/2007 | Walker et al. | |
| 2007/0251690 | A1 | 11/2007 | Whitsitt et al. | |
| 2008/0035349 | A1 * | 2/2008 | Richard | 166/308.1 |
| 2008/0217025 | A1 | 9/2008 | Ruddock et al. | |
| 2009/0044944 | A1 * | 2/2009 | Murray et al. | 166/308.1 |
| 2009/0044945 | A1 | 2/2009 | Willberg et al. | |
| 2009/0056934 | A1 | 3/2009 | Xu | |
| 2009/0084553 | A1 * | 4/2009 | Rytlewski et al. | 166/305.1 |
| 2009/0194273 | A1 | 8/2009 | Surjaatmadja et al. | |
| 2009/0260815 | A1 | 10/2009 | Malone | |
| 2009/0301708 | A1 | 12/2009 | Savoy et al. | |
| 2010/0126724 | A1 | 5/2010 | Surjaatmadja et al. | |
| 2011/0114319 | A1 | 5/2011 | Xu et al. | |
| 2011/0187062 | A1 | 8/2011 | Xu | |

FOREIGN PATENT DOCUMENTS

| | | | |
|---|---|---|---|
| GB | 2316967 | A | 3/1998 |
| WO | WO 92/20900 | | 11/1992 |
| WO | WO 02/10554 | A1 | 2/2002 |
| WO | WO/02 068793 | A1 | 9/2002 |
| WO | WO 02/068793 | A1 | 9/2002 |
| WO | WO 2004088091 | A1 | 10/2004 |

OTHER PUBLICATIONS

International Search Report, Dec. 15, 2011, pp. 1-3, PCT/US2011/040805, Korean Intellectual Property Office.

Written Opinion of the International Searching Authority, Dec. 15, 2011, pp. 1-4, PCT/US2011/040805, Korean Intellectual Property Office.

E. Paul Bercegeay, A One-Trip Gravel Packing System, Feb. 7, 1974, pp. 1-12, SPE 4771, American Institute of Mining, Metallurgical, and Petroleum Engineers, Inc., U.S.A.

Henry Restarick, Horizontal Completion Options in Reservoirs With Sand Problems, Mar. 11, 1995, pp. 545-560, SPE 29831, Society of Petroleum Engineers, Inc., U.S.A.

E. Harold Vickery, Application of One-Trip Multi-Zone Gravel Pack to Maximize Completion Efficiency, Oct. 12, 2000, pp. 1-10, SPE 64469, Society of Petroleum Engineers Inc., U.S.A.

Stephen P. Mathis, Sand Management: A Review of Approaches and Concerns, May 13, 2003, pp. 1-7, SPE 82240, Society of Petroleum Engineers Inc., U.S.A.

G.L. Rytlewski, A Study of Fracture Initiation Pressures in Cemented Cased Hole Wells Without Perforations, May 15, 2006, pp. 1-10, SPE 100572, Society of Petroleum Engineers, U.S.A.

Nicholas J. Clem, et al., Utilizing Computational Fluid Dynamics (CFD) Analysis as a Design Tool in Frac Packing Application to Improve Erosion Life, SPE Annual Technical Conference and Exhibition, Sep. 24-27, 2006, SPE 102209, Society of Petroleum Engineers, San Antonio, Texas, USA.

StageFRAC Maximize Reservoir Drainage, 2007, pp. 1-2, Schlumberger, U.S.A.

Brad Musgrove, Multi-Layer Fracturing Solution Treat and Produce Completions, Nov. 12, 2007, pp. 1-23, Schlumberger, U.S.A.

K.L. Smith, et al., "Ultra-Deepwater Production Systems Technical Progress Report," U.S. Department of Energy, Science and Technical Information, Annual Technical Progress Report, Jan. 2005, pp. 1-32, ConocoPhillips Company, U.S.A.

* cited by examiner

AUTO-PRODUCTION FRAC TOOL

BACKGROUND

1. Field of Invention

The invention is directed to fracturing tools for use in oil and gas wells, and in particular, to fracturing tools having two moveable sleeves capable of providing two operational positions so that the fracturing tool can fracture the formation in the first operational position and then be moved, without well intervention, to the second operational position to produce return fluids from the well.

2. Description of Art

Fracturing or "frac" systems or tools are used in oil and gas wells for completing and increasing the production rate from the well. In deviated wellbores, particularly those having longer lengths, fracturing fluids can be expected to be introduced into the linear, or horizontal, end portion of the well to frac the production zone to open up production fissures and pores therethrough. For example, hydraulic fracturing is a method of using pump rate and hydraulic pressure created by fracturing fluids to fracture or crack a subterranean formation.

In addition to cracking the formation, high permeability proppant, as compared to the permeability of the formation, can be pumped into the fracture to prop open the cracks caused by a first hydraulic fracturing step. For purposes of this disclosure, the proppant is included in the definition of "fracturing fluids" and as part of well fracturing operations. When the applied pump rates and pressures are reduced or removed from the formation, the crack or fracture cannot close or heal completely because the high permeability proppant keeps the crack open. The propped crack or fracture provides a high permeability path connecting the producing wellbore to a larger formation area to enhance the production of hydrocarbons.

One result of fracturing a well is that the return fluids, e.g., oil, gas, water, that are sought to be removed from the well are mixed with sand and other debris broken loose in the formation. As a result, after fracturing, an intervention step is performed to reorient a downhole tool such as a frac tool so that the return fluids are passed through a screen or other device to filter out the sand and debris. This intervention step usually involves dropping a ball or other plug element into the well to isolate a portion of the well or to actuate the frac tool to move an actuator to open a fluid flow path through the screen and closes a fluid flow path through which the fracturing fluid was previously injected into the well or well formation.

SUMMARY OF INVENTION

After being run-in to the well in a non-operational "run-in" position and moved to a first operational position, the frac tools disclosed herein are capable of orienting themselves into a second operational position without the need for an intervention step to move the frac tools from the first operational position to the second operational position. The term "operational position," means that the frac tool is oriented within a well in such a manner so that well completion, well production, or other methods can be performed to the well by the frac tool. In other words, "operational position," means that the frac tool is oriented within in a well so that the frac tool can perform the function(s) for which it was designed.

Broadly, the frac tools include a housing having a bore defined by an inner wall surface. The housing includes a series of ports, e.g., at least two ports, one of which may include a fluid flow control member such as a screen or filter used to prevent debris from entering the frac tool or a device for controlling the rate of fluid flow through the port. This "fluid flow controlled" port is disposed below the other port lacking the fluid flow control member. This "fluid flow controlled" port is referred to a production port because production fluids flow from the wellbore or formation through the production port. The other port is referred to as a frac port because fracturing fluids are pumped down the tool and out of the frac port into the wellbore or formation during fracturing or "frac" operations.

The tools include an inner sleeve having upper and lower ports that can be aligned with upper and lower ports of the housing. The inner sleeve includes an actuator for movement of the inner sleeve along the inner wall surface of the housing. The inner sleeve comprises two positions. A first position in which the inner sleeve blocks the upper ports of the housing and a second position in which the upper port of the inner sleeve is aligned with and in fluid communication with the upper port of the housing so that a first operation such as "fracing" can be performed. In the first position, the lower ports of the inner sleeve and housing are aligned, however, they are not in fluid communication with each other because fluid flow restrictor, such as an outer sleeve disposed in a chamber partially formed by the outer wall surface of the inner sleeve and the inner wall surface of the housing, blocks fluid flow between the lower port of the inner sleeve and the lower port of the housing.

To move the inner sleeve from its first position to its second position an inner sleeve actuator, such as a ball seat, can be activated. Upon reaching the second position, the upper port of the inner sleeve is aligned with and in fluid communication with the upper port in the housing of the frac tool. Meanwhile, the outer sleeve, which is initially secured in place to either the inner sleeve or the housing, continues to block fluid flow between the lower port of the inner sleeve and the lower port of the housing. Movement of the inner sleeve downward to align the upper port of the inner sleeve with the upper port of the housing releases the outer sleeve so that it can slide along the outer wall surface of the inner sleeve and the inner wall surface of the housing. As a result of the alignment of the upper port of the inner sleeve with the upper port of the housing, fracturing fluid is allowed to flow from the bore of the frac tool and into the well to fracturing the well or formation.

After the first operation is performed by the frac tools, the inner sleeve returns to its initial or first position such as by the reducing the flow pressure of the fracturing fluid or through the inclusion of a return chamber, such as an atmospheric chamber, which facilitates movement of the inner sleeve from its second position to its first position. In so doing, the upper housing port is again blocked by the inner sleeve and the outer sleeve is moved from its initial or first position to its second position. Movement of the outer sleeve from its initial position can be performed by an outer sleeve actuator operatively associated with the inner and outer sleeves. As a result of the movement of outer sleeve, the lower port of the inner sleeve, which is already aligned with the lower port of the housing because the inner sleeve has been returned to its first position, is placed in fluid communication with the lower port of the housing. In this configuration, a second operation, such as producing return fluids from the well or formation through the lower ports, into the bore of the housing, and up to the surface of the well, can be performed by the frac tool.

Figure 1:
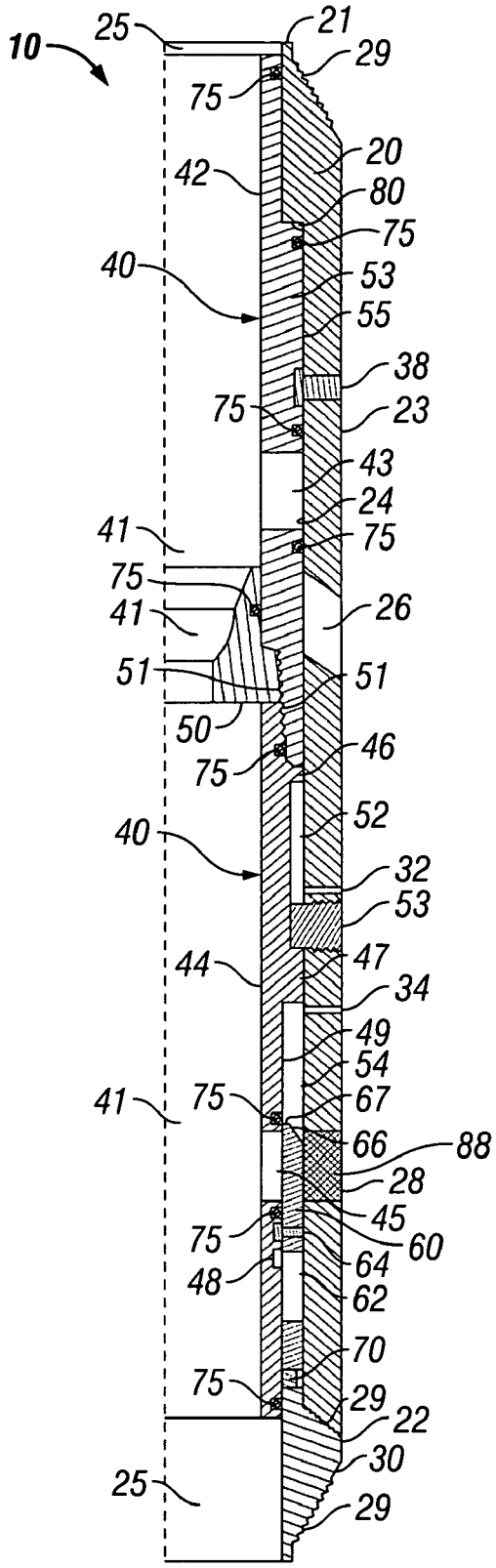
FIG. 1 is a cross-sectional view of one specific embodiment of the fracturing tool disclosed herein shown in the run-in position.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

Referring now to FIGS. 1-4, fracturing or frac tool 10 includes outer housing 20 having upper end 21, lower end 22, outer wall surface 23, inner wall surface 24 defining bore 25 (shown best in FIG. 2), upper ports 26, and lower ports 28. Attachment members such as threads 29 are disposed at upper and lower ends 21, 22 to facilitate attaching frac tool 10 to additional components of a downhole tool or work string. As shown in the embodiment of FIGS. 1-4, threads 29 are disposed along outer wall surface 23 at upper end 21 and are disposed along inner wall surface 24 of lower end 22 to facilitate attachment of cap 30 to lower end 22 of frac tool 10. As discussed in greater detail below, cap 30 facilitates formation of lower chamber 54. Housing 20 also includes upper pressure relief port 32 and lower pressure relief port 34 which are discussed in greater detail below.

Lower housing ports 28 may include a fluid flow control member or device such as screen 88 that allows liquids to flow through lower housing ports 28, but prevents certain sized particulate matter from flowing through lower housing ports 28. Lower housing ports 28 may also include a second fluid flow control member such as a choke (not shown), that is capable of controlling the pressure drop and flow rate through lower housing ports 28. In one particular embodiment, lower housing ports 28 include screen 88 and a choke.

Figure 2:
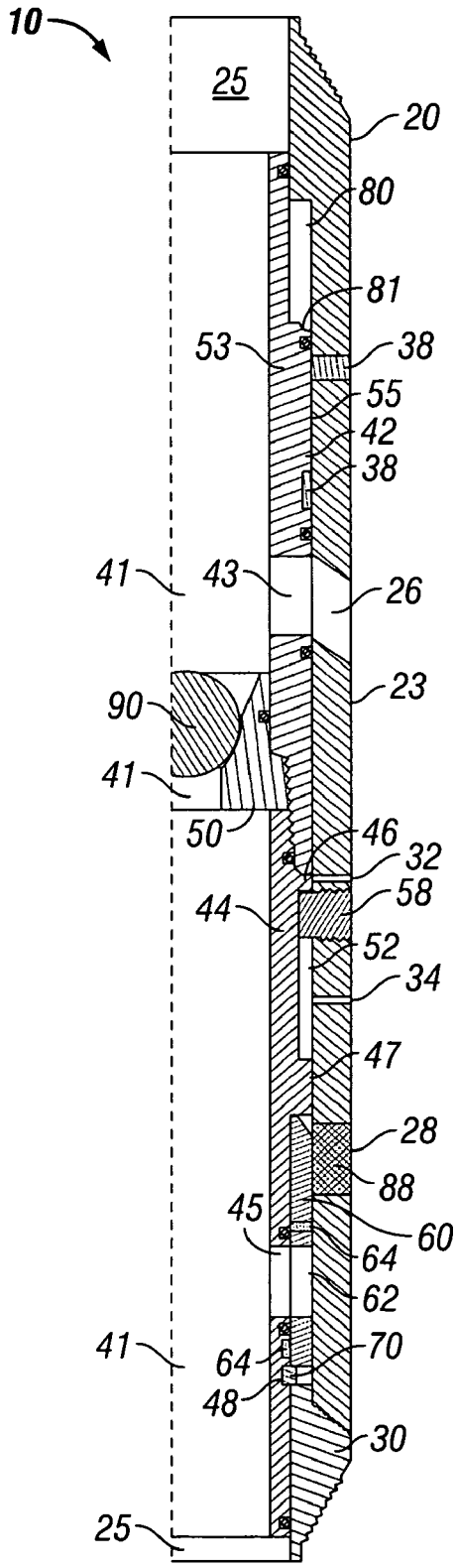
FIG. 2 is a cross-sectional view of the fracturing tool of FIG. 1 shown in the first operational, or fracturing, position.
Figure 3:
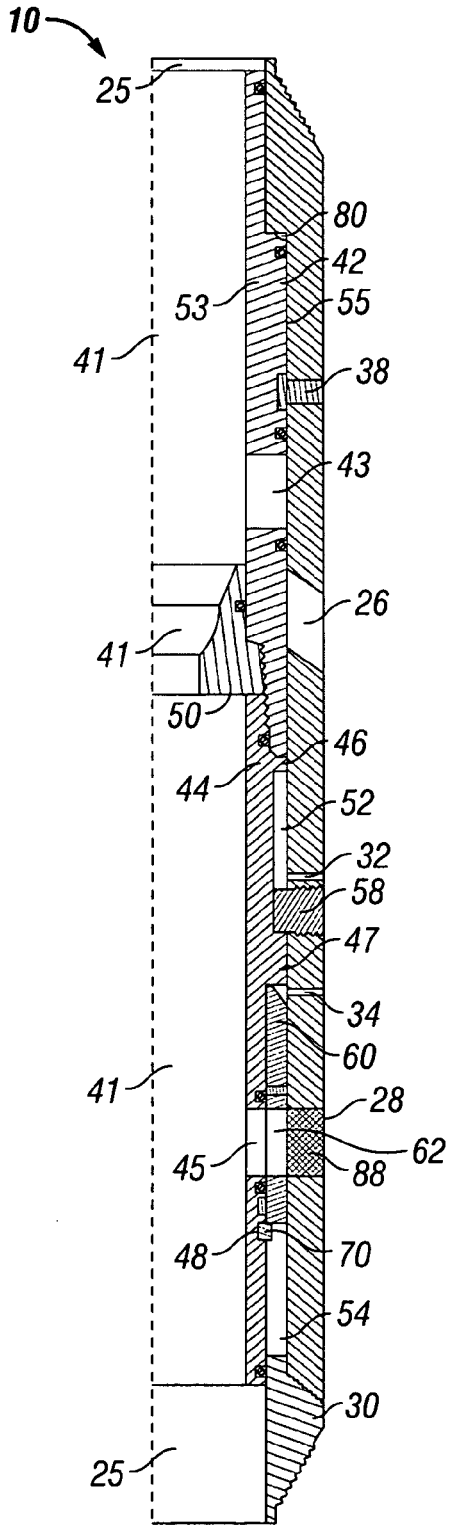
FIG. 3 is a cross-sectional view of the fracturing tool of FIG. 1 shown in the second operational, or producing, position.
Figure 4:
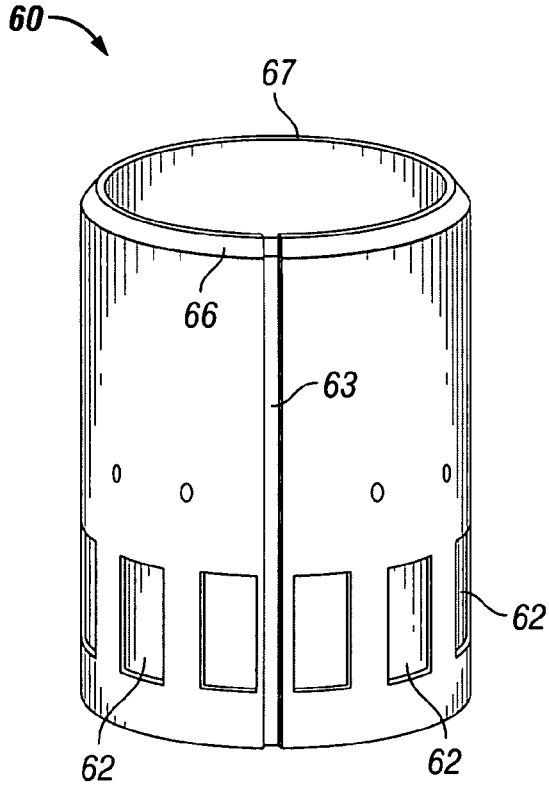
FIG. 4 is a perspective view of a specific outer sleeve of the fracturing tool of FIGS. 1-3.

Inner sleeve 40 is in sliding engagement with inner wall surface 24 and comprises bore 41 and an actuator for moving inner sleeve 40 from the run-in position (FIG. 1) to the first operational position (FIG. 2). The actuator may be any device or method known to persons of ordinary skill in the art. In the embodiment of FIGS. 1-3, the actuator is a seat such as ball seat 50 capable of receiving plug element such as ball 90 (FIG. 2). Although FIGS. 1-3 show ball seat 50 and ball 90, it is to be understood that the seat is not required to be a ball seat and the plug element is not required to a ball. Instead, the seat can have any other shape desired or necessary for receiving a reciprocally shaped plug element.

Inner sleeve 40 can be rotated with respect to production sleeve 44 to align inner sleeve ports 43 with upper housing ports 26, and this alignment can be fixed. For example, ball seat 50 can include a provision for tool engagement (not shown), such as a transverse slot, in order that ball seat 50 can be tightened against production sleeve 44 to lock the alignment between inner sleeve 40 and production sleeve 44.

As shown in the specific embodiment of FIGS. 1-4, inner sleeve 40 comprises frac sleeve 42, production sleeve 44, and ball seat 50. Although shown in the Figures and described herein as being formed from separate components attached to each other through threads 51, it is to be understood that inner sleeve 40 and ball seat 50 may be comprised of less components than shown, including a single sleeve component having ball seat 50 formed as part of the single component.

Frac sleeve 42 includes upper sleeve port 43 and is initially secured to housing 10 by a releasable retaining member such as shear screw 38. At its upper end, frac sleeve 42 also includes a flange portion, or shoulder 53 disposed on outer wall surface 55 of frac sleeve 42. As discussed in greater detail below, flange portion or shoulder 57 provides return chamber 80. As shown best in FIG. 2, flange portion or shoulder 57 includes profile 81 on its upper end to facilitate formation of return chamber 80.

Production sleeve 44 comprises lower sleeve port 45, upper and lower flanges 46, 47 disposed on outer wall surface 49 of production sleeve 44, and recess or groove 48 disposed on outer wall surface 49 of production sleeve 44. Inner wall surface 24 of housing 20, outer wall surface 49 of inner sleeve 40, upper flange 46, and lower flange 47 form upper chamber 52. Inner wall surface 24 of housing 20, outer wall surface 49 of inner sleeve 40, lower flange 47, and cap 30 from lower chamber 54. Alternatively, an inner flange (not shown) may be disposed at lower end 22 of housing 20 in place of cap 30. Or, an outer flange (not shown) may be disposed at the lower end of inner sleeve 40 in place of cap 30. When inner sleeve 40 is in its first position (FIG. 1), upper chamber 52 is in fluid communication with upper pressure relief port 32 and lower chamber 54 is in fluid communication with lower pressure relief port 34 and lower housing port 28. When inner sleeve 40 is in its second position (FIG. 2), upper chamber 52 is in fluid communication with lower pressure relief port 34 and lower chamber 54 is in fluid communication with lower housing port 28. And, when inner sleeve 40 has been returned to its first position and outer sleeve 60 is moved to its second position, upper chamber 52 is in fluid communication with upper pressure relief port 32 and lower chamber is in fluid communication with lower pressure relief port 34. Thus, both upper chamber 52 and lower chamber 54 are hydrostatic chambers.

Key 58 is disposed within upper chamber 52, through housing 20 below upper pressure relief port 32, below upper flange 46, and above lower flange 47, and in sliding engagement with outer wall surface 49 of production sleeve 44. Alternatively, key 58 can be replaced with an inner flange (not shown) disposed on inner wall surface 24 at the appropriate location. Key 58 divides upper chamber 52 into two portions. Key 58 provides a stop to prevent downward sliding of production sleeve 44 at a predetermined location along inner wall surface 24 such as the location where upper flange 46 engages key 58 (see FIG. 2) so that groove 48 is aligned with snap ring 70 (see FIG. 2), which is discussed in greater detail below.

Disposed in lower chamber 54 is outer ring or outer sleeve 60. Initially, outer sleeve is disposed toward the bottom of the lower chamber 54. Outer sleeve 60 is in sliding engagement with inner wall surface 24 and outer wall surface 49 of production sleeve 44. Outer sleeve 60 includes ports 62 and is initially attached to production sleeve 44 by shear screw 64. Disposed towards a lower end of outer sleeve 60 in lower chamber 54 is snap ring 70. Snap ring 70 may be part of outer sleeve 60, connected to outer sleeve 60, or a separate component from outer sleeve 60. Snap ring 70 is initially energized such that when it is aligned with groove 48, snap ring 70 contracts and is secured within groove 48. As a result, outer sleeve 60 can be moved by the movement of inner sleeve 40.

Outer sleeve 60 may also comprise a passage such as pressure relief groove 63 (FIG. 4) or bevel 66 disposed at upper end 67. Pressure relief groove 63 and bevel 66 facilitate fluid communication between lower housing port 28 and the space of lower chamber 52 located above outer sleeve 60 and below lower flange 47 when frac tool is in its run-in and first operational positions (FIGS. 1-2) and to facilitate fluid communication between lower housing port 28 and the space of lower chamber 52 located below outer sleeve 60 and above cap 30 when frac tool 10 is in the second operational position (FIG. 3).

Return chamber 80 is disposed toward the upper end of inner sleeve 40 and is formed by housing 20 and frac sleeve 42. As discussed in greater detail below, return chamber 80 facilitates movement of frac sleeve 42 to its first position after fracturing operations have been completed. In the embodiment illustrated in the Figures, return chamber 80 is an atmospheric chamber. It is to be understood, however, that return chamber can be modified, which may require relocation of return chamber 80 to the outer wall surface 55 of frac sleeve 42, to include a biased member such as a coiled spring or other device that is energized when inner sleeve 40 is moved from its first position to its second position.

Seals 75 (numbered only in FIG. 1) are disposed throughout frac tool 10 to provide sealing engagement and reduce the likelihood of leaks between the various surfaces shown. Seals 75 may be elastomeric, metal or any other type of seal known in the art.

As illustrated in FIG. 2, ball 90 engages ball seat 50 to restrict fluid flow through bore 41. Fluid pressure, such as by pumping fracturing fluid (not shown) down through bores 25, 41 is exerted onto ball 90 causing shear screw 38 to break or shear to release frac sleeve 42 from inner wall surface 24 so that frac sleeve 42, production sleeve 44, and ball seat 50 are forced downward. In so doing, return chamber 80 becomes enlarged and, thus, energized. Additionally, shear screw 64 is broken or sheared, groove 48 is aligned with snap ring 70 so that snap ring 70 releases its stored energy and engages or locks into groove 48, the volume of lower chambers 54 is reduced and the top of upper chamber 52 is moved toward key 58. The reduction of volume of lower chamber 54 and the movement of the top of upper chamber 52 toward key 48 are facilitated by upper and lower pressure relief ports 32, 34 and lower housing port 28 because fluid is permitted to flow into and out of the upper and lower chambers 52, 54 as appropriate. In particular, during movement of inner sleeve 40 toward its second position, fluid flows out of pressure relief port 32 and into pressure relief port 34. Fluid also flows out of lower chamber through lower housing port 28, which is facilitated by one or both of pressure relief groove 63 and bevel 66.

Upon providing the arrangement as shown in FIG. 2, upper sleeve ports 43 are aligned with upper housing ports 26 and, thus, frac tool 10 is in its first operational position. Accordingly, fracturing operations can be performed by pumping fracturing fluid from bore 25, through upper sleeve port 43, through upper housing port 26, and into well or well formation to fracture the formation.

As shown in FIG. 3, after sufficient fracturing fluid is injected into the well or open hole formation, ball 90 is removed from ball seat 50 through any method known to persons skilled in the art. For example, ball 90 may be removed from ball seat 50 by increasing the fluid pressure of the fracturing fluid being pumped downward through bores 25, 41 until ball 90 is forced through ball seat 50 so that it can fall to the bottom of the well. Alternatively, ball 90 may be removed from ball seat 90 by decreasing the fluid pressure of the fracturing fluid being pumped downward through bores 25, 41 so that ball can float back to the surface of the well.

Reduction of the fluid pressure of the fracturing fluid, either after forcing ball 90 through ball seat 50, or after allowing ball 90 to float to the surface of the well, allows energized return chamber 80 to overcome the downward force of the fluid being, or previously being, pumped downward through bores 25, 41. As a result, frac sleeve 42 and, thus, production sleeve 44 and outer sleeve 60 which is now attached to production sleeve 44 through snap ring 70, and ball seat 50 move upward from the first operational position (FIG. 2) to provide the second operational position (FIG. 3). In this position, outer sleeve 60 is disposed toward the top of chamber 54.

Additionally, upper sleeve ports 43 are no longer aligned with upper housing ports 26, but lower sleeve ports 45 are aligned with lower housing ports 28. Accordingly, return fluids, such as oil, gas, and water, are permitted to flow from the well or well formation and into bores 25, 41 so that the return fluids can be collected at the surface of the well.

In operation, frac tool 10 is disposed on a tubing or casing string through attachment members such as threads 29 disposed at upper and lower ends 21, 22 of housing 20. The string is then lowered into the well to the desired location. During this run-in step, inner sleeve 40 is in its first position and frac tool 10 is in its run-in position (FIG. 1). In this position, upper housing ports 26 are blocked by inner sleeve 40, lower sleeve ports 45 are aligned with lower housing ports 28, but outer sleeve 60 blocks fluid communication between the lower sleeve ports 45 and the lower housing ports 28.

Upon reaching the desired location or zone within the wellbore, inner sleeve 40 is moved from its first position to its second position to provide the first operational position (FIG. 2) of frac tool 10. In the embodiment shown in the Figures, inner sleeve 40 is moved from its first position to its second position (FIG. 2) by restricting fluid flow through bores 25, 41 such as by dropping a plug element such as ball 90 into bore 41 and landing the plug element on seat 50 and pumping fracturing fluid down bores 25, 41 to force inner sleeve 40 downward. In so doing, upper sleeve ports 43 are aligned with upper housing ports 26, lower sleeve ports 45 are aligned with outer sleeve ports 62, and production sleeve 44 is engaged with outer sleeve 60 such as through snap ring 70. Outer sleeve 60 continues to block fluid communication between lower sleeve ports 45 and lower housing ports 28. In addition, return chamber 80 becomes energized.

In the first operational position of frac tool 10 (FIG. 2), fracturing fluid is allowed to flow from bore 41 into well or well formation to fracture the formation. After an amount of time has passed to fracture the formation as desired or necessary to stimulate hydrocarbon production from the well, fracturing fluid is no longer pumped downward through bores 25, 41. In the embodiment shown in the Figures, ball 90 is removed, either by forcing ball through ball seat 50 or by allowing ball 90 to float to the surface of the well. Due to the reduction in fluid pressure acting to force inner sleeve 40 downward, the energized return chamber 80 facilitates movement of inner sleeve 40 upward from its second position (FIG. 2) to its first position. As a result, upper housing ports 26 are closed off.

During movement of inner sleeve 40 upward, outer sleeve 60 is also pulled upward due to the engagement of snap ring 70 with groove 48. As illustrated in FIG. 3, movement of inner sleeve 40 and outer sleeve 60 upward returns inner sleeve 40 to its first position and places lower sleeve port 45 back in alignment with lower housing ports 28. Because lower sleeve port 45 is aligned with outer sleeve port 62, lower sleeve port 45 is placed in fluid communication with lower housing port 28. Thus, frac tool 10 is placed in its second operational position (FIG. 3).

Once oriented in the second operational position of frac tool 10 (FIG. 3), return fluids are allowed to flow from the well or well formation through lower housing ports 28, outer sleeve port 62, lower sleeve ports 45, bore 41, and bore 25 so that the return fluids can flow to the surface of the well for collection.

As will be recognized by persons of ordinary skill in the art, movement of frac tool 10 from the first operational position (FIG. 2) to the second operational position (FIG. 3) did not require any well intervention using another tool or device. All that was required was the manipulation of forces acting on inner sleeve 40 to properly align inner sleeve 40 with the upper and lower housing ports 26, 28 and outer sleeve port 62.

In the embodiments discussed herein with respect FIGS. 1-4, upward, toward the surface of the well (not shown), is toward the top of FIGS. 1-4, and downward or downhole (the direction going away from the surface of the well) is toward the bottom of FIGS. 1-4. In other words, "upward" and "downward" are used with respect to FIGS. 1-4 as describing the vertical orientation illustrated in FIGS. 1-4. However, it is to be understood that frac tool 30 may be disposed within a horizontal or other deviated well so that "upward" and "downward" are not oriented vertically.

It is to be understood that the invention is not limited to the exact details of construction, operation, exact materials, or embodiments shown and described, as modifications and equivalents will be apparent to one skilled in the art. For example, return chamber 80 may be disposed within frac sleeve 42 such that movement of frac sleeve 42 causes a return member or biased member such as a coiled spring, a belleville spring (also known as belleville washers), capillary springs, deformable elastomer, polymer, or rubberized elements, or another elastic device that is capable of being energized to exert a force upward or against the flow of fluid against ball 90 when inner sleeve 40 is moved from its first position (FIGS. 1 and 3) to its second position (FIG. 2) to be energized so that after downward fluid pressure is decreased, the return member facilitates movement of inner sleeve 40 toward its first position. Additional suitable return members include actuators energized by hydraulic pressure, hydrostatic pressure or electrical power such as from battery packs having electrical timers. Additionally, the actuator for moving the inner sleeve from its first position to its second position may be a piston that is actuated using hydrostatic or other pressure. In addition, releasable restraining members or devices other than shear screws may be used to maintain certain components of the frac tools in their initial positions. Moreover, the key can be replaced by a flange disposed on the inner wall surface of the housing. Similarly, the cap can be replaced by a flange disposed on the outer wall surface of the inner sleeve toward the lower end of the inner sleeve, or by a flange disposed on the inner wall surface of the housing toward the lower end of the housing. In addition, outer sleeve may be a valve or other fluid flow restrictor. Accordingly, the invention is therefore to be limited only by the scope of the appended claims.

What is claimed is:

1. A downhole tool comprising:

a housing having an inner wall surface defining a bore, a first housing port, and a second housing port disposed below the first port;

an inner sleeve in sliding engagement with the inner wall surface of the housing, the inner sleeve having an inner sleeve outer wall surface and an inner sleeve actuator for moving the inner sleeve from a first inner sleeve position to a second inner sleeve position; and a fluid flow restrictor having an opened position providing fluid communication between the housing bore and the second housing port and a closed position blocking fluid communication between the housing bore and the second housing port, the fluid flow restrictor being disposed between the inner sleeve and the inner wall surface of the housing and being operatively associated with the inner sleeve, wherein, when the inner sleeve is in the first inner sleeve position, the first housing port is blocked by the inner sleeve and the fluid flow restrictor is in the closed position blocking fluid communication between the housing bore and the second housing port, wherein, when the inner sleeve is in the second inner sleeve position, the housing bore is in fluid communication with the first housing port and the fluid flow restrictor is in the closed position blocking fluid communication between the housing bore and the second housing port, and wherein, when the inner sleeve is moved from the second position toward the first position, the fluid flow restrictor is moved from the closed position to the opened position placing the housing bore in fluid communication with the second housing port.

2. The downhole tool of claim 1, wherein the inner sleeve actuator comprises a seat disposed in a sleeve bore, the seat being actuatable by a plug element so that the inner sleeve can be moved from the first inner sleeve position to the second inner sleeve position by fluid pressure forcing the plug element into the seat.

3. The downhole tool of claim 2, wherein the seat comprises a ball seat and the plug element comprises a ball.

4. The downhole tool of claim 1, further comprising a return chamber operatively associated with the inner sleeve, the return chamber being energized when the inner sleeve is in the second inner sleeve position and the return chamber not being energized when the inner sleeve is in the first inner sleeve position.

5. The downhole tool of claim 4, wherein the return chamber comprises an atmospheric chamber.

6. The downhole tool of claim 1, wherein the fluid flow restrictor comprises an outer sleeve, the outer sleeve being in sliding engagement with the inner wall surface of the housing and the outer wall surface of the inner sleeve, the outer sleeve having an outer sleeve port and an outer sleeve actuator for moving the outer sleeve from the closed position to the opened position, and wherein the outer sleeve port is in fluid communication with the housing bore and the second housing port when the outer sleeve is in the opened position.

7. The downhole tool of claim 6, wherein the outer sleeve actuator comprises a groove disposed on the outer wall surface of the inner sleeve and a snap ring operatively associated with the outer sleeve.

8. The downhole tool of claim 6, wherein the outer wall surface of the inner sleeve comprises an upper flange and a lower flange, the upper flange providing an upper hydrostatic chamber, and the lower flange providing a lower hydrostatic chamber.

9. The downhole tool of claim 8, wherein the housing comprises an upper pressure relief port, the upper pressure relief port being in fluid communication with the upper hydrostatic chamber when the inner sleeve is in the first inner sleeve position.

10. The downhole tool of claim 9, wherein the housing comprises a lower pressure relief port, the lower pressure relief port being in fluid communication with the lower hydrostatic chamber when the inner sleeve is in the first inner sleeve position.

11. The downhole tool of claim 10, wherein an upper end of the outer sleeve comprises a bevel for providing fluid communication between the lower hydrostatic chamber and the second housing port when the outer sleeve is in the closed position.

12. The downhole tool of claim 1, wherein the inner sleeve comprises a first inner sleeve port, the first inner sleeve port being in fluid communication with the first housing port when the inner sleeve is in the second inner sleeve position.

13. The downhole tool of claim 12, wherein the inner sleeve comprises a second inner sleeve port disposed below the first inner sleeve port, the second inner sleeve port being in fluid communication with the second housing port when the fluid flow restrictor is in the opened position.

14. The downhole tool of claim 1, wherein the inner sleeve comprises a first inner sleeve port, the first inner sleeve port being in fluid communication with the second housing port when the fluid flow restrictor is in the opened position.

15. A downhole tool comprising:

a housing have a bore, an inner wall surface, the inner wall surface defining the bore, an outer wall surface, an upper housing port, and a lower housing port, the upper housing port and the lower housing port providing fluid communication with the bore through the inner wall surface and the outer wall surface;

an inner sleeve in sliding engagement with the inner wall surface of the housing, the inner sleeve comprising a flange disposed on an outer wall surface of the inner sleeve, the flange providing a hydrostatic chamber between the outer wall surface of the inner sleeve and the inner wall surface of the housing, an upper inner sleeve port, and a lower inner sleeve port;

an inner sleeve actuator for moving the inner sleeve from the first inner sleeve position to the second inner sleeve position, the first inner sleeve position blocking fluid communication between the upper inner sleeve port and the upper housing port, and the second inner sleeve position providing fluid communication between the upper inner sleeve port and the upper housing port;

an outer sleeve disposed in the hydrostatic chamber, the outer sleeve comprising a passage disposed on an outer wall surface of the outer sleeve to provide fluid communication between the lower housing port and the hydrostatic chamber; and an outer sleeve actuator for movement of the outer sleeve from a first outer sleeve position to a second outer sleeve position, the first outer sleeve position blocking fluid communication between the lower inner sleeve port and the lower housing port, and the second outer sleeve position providing fluid communication between the lower inner sleeve port and the lower housing port, wherein, the outer sleeve is moved from the first outer sleeve position to the second outer sleeve position by movement of the inner sleeve from the second inner sleeve position toward the first inner sleeve position.

16. The downhole tool of claim 15, further comprising a return chamber operatively associated with the inner sleeve, the return chamber being energized when the inner sleeve is in the second inner sleeve position and the return chamber not being energized when the inner sleeve is in the first inner sleeve position.

17. The downhole tool of claim 15, wherein the inner sleeve actuator comprises a seat disposed in a sleeve bore, the seat being actuatable by a plug element so that the inner sleeve can be moved from the first inner sleeve position to the second inner sleeve position by fluid pressure forcing the plug element into the seat.

18. The downhole tool of claim 15, wherein the outer sleeve actuator comprises a groove disposed on the outer wall surface of the inner sleeve and a snap ring operatively associated with the outer sleeve.

19. The downhole tool of claim 15, wherein the outer sleeve comprises an outer sleeve port, the outer sleeve port being placed in fluid communication with the lower inner sleeve port and the lower housing port when the outer sleeve is placed in the second outer sleeve position.

20. A method of fracturing and producing fluids from a well, the method comprising the steps of:

(a) disposing a frac tool in a string, the frac tool comprising a housing having an inner wall surface defining a bore, a first housing port, and a second housing port disposed below the first housing port, an inner sleeve in sliding engagement with the inner wall surface of the housing, the sleeve having an inner sleeve outer wall surface, a first inner sleeve position, and a second inner sleeve position, and a fluid flow restrictor disposed between the inner sleeve and the inner wall surface of the housing, the fluid flow restrictor comprising an opened position providing fluid communication between the housing bore and the second housing port and a closed position blocking fluid communication between the housing bore and the second housing port, the fluid flow restrictor being operatively associated with the inner sleeve, wherein, when the inner sleeve is in the first inner sleeve position, the first housing port is blocked by the inner sleeve, wherein, when the inner sleeve is in the second inner sleeve position, the housing bore is in fluid communication with the first housing port, and wherein, when the inner sleeve is moved from the second inner sleeve position toward the first inner sleeve position, the fluid flow restrictor is moved from the closed position to the opened position;

(b) lowering the string into the well;

(c) moving the inner sleeve from the first inner sleeve position to the second inner sleeve position placing the housing bore in fluid communication with the first housing port;

(d) fracturing the well by pumping a fracturing fluid through the housing bore, through the first housing port, and into the well;

(e) reducing the flow of the fracturing fluid through the bore and through the first housing port;

(f) moving the inner sleeve from the second inner sleeve position toward the first inner sleeve position causing the fluid flow restrictor to move from the closed position to the opened position placing the housing bore in fluid communication with the second housing port; and (g) producing fluids from the well by flowing fluids from the well, through the second housing port, and into the bore of the housing.

21. The method of claim 20, wherein the inner sleeve is moved from the first inner sleeve position to the second inner sleeve position by disposing a plug element on a seat disposed within an inner sleeve bore of the inner sleeve so that fluid pressure builds up above the plug element to force the inner sleeve from the first inner sleeve position to the second inner sleeve position.

22. The method of claim 20, wherein step (f) is performed by releasing energy stored in a return chamber operatively associated with the inner sleeve, wherein the return chamber is energized during movement of the inner sleeve from the first inner sleeve position to the second inner sleeve position.

23. The method of claim 22, wherein the fluid flow restrictor is moved from the closed position to the opened position by actuating an actuator operatively associated with the inner sleeve and the fluid flow restrictor.

* * * * *